US009099078B2

(12) United States Patent
Neusinger et al.

(10) Patent No.: US 9,099,078 B2
(45) Date of Patent: Aug. 4, 2015

(54) UPMIXER, METHOD AND COMPUTER PROGRAM FOR UPMIXING A DOWNMIX AUDIO SIGNAL

(75) Inventors: Matthias Neusinger, Rohr (DE); Julien Robilliard, Nuremberg (DE); Johannes Hilpert, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 417 days.

(21) Appl. No.: 13/191,236

(22) Filed: Jul. 26, 2011

(65) Prior Publication Data

US 2012/0020499 A1 Jan. 26, 2012

Related U.S. Application Data

(63) Continuation of application No. PCT/EP2010/050287, filed on Jan. 12, 2010.

(60) Provisional application No. 61/147,810, filed on Jan. 28, 2009.

(30) Foreign Application Priority Data

Sep. 28, 2009 (EP) ..... 09012285

(51) Int. Cl.
*G10L 19/00* (2013.01)
*G10L 19/008* (2013.01)

(52) U.S. Cl.
CPC ..... *G10L 19/008* (2013.01)

(58) Field of Classification Search
CPC ..... H04R 5/00; G10L 19/00
USPC ..... 381/17, 22–23, 119; 704/500–501, 704/E19.001
See application file for complete search history.

(56) References Cited

U.S. PATENT DOCUMENTS 7,283,634 B2 10/2007 Smith
7,394,903 B2 7/2008 Herre et al.
(Continued)

FOREIGN PATENT DOCUMENTS

AU 2010209872 8/2010
EP 1565036 A2 8/2005
(Continued)

OTHER PUBLICATIONS

Breebaart, et al., "Background, concept, and architecture for the recent MPEG surround standard on multichannel audio compression", Journal of the AES, vol. 55, No. 5, New York, NY, XP008099918, Section 4.2, May 2007, pp. 331-351.
Breebaart, et al., "High-Quality Parametric Spatial Audio Coding at Low Bit Rates", Audio Engineering Society Convention Paper, 116th Convention, Berlin, Germany, May 2004, 13 pages.
Faller, et al., "Binaural Cue Coding—Part II: Schemes and Applications", IEEE Transactions on Speech and Audio Processing, vol. 11, No. 6, Nov. 2003, pp. 1-12.
(Continued)

*Primary Examiner* — Disler Paul
(74) *Attorney, Agent, or Firm* — Michael A. Glenn; Perkins Coie LLP

(57) ABSTRACT

An upmixer for upmixing a downmix audio signal into an upmixed audio signal describing one or more upmixed audio channels includes a parameter applier configured to apply upmixing parameters to upmix the downmix audio signal in order to obtain the upmixed audio signal. The parameter applier is configured to apply a phase shift to the downmix audio signal to obtain a phase-shifted version of the downmix audio signal, while leaving a decorrelated signal unmodified by the phase shift. The parameter applier is further configured to combine the phase-shifted version of the downmix audio signal with the decorrelated signal to obtain the upmixed audio signal.

17 Claims, 5 Drawing Sheets

(56) References Cited

U.S. PATENT DOCUMENTS

| | | | | |
|---|---|---|---|---|
| 7,668,722 | B2 * | 2/2010 | Villemoes et al. | 704/500 |
| 8,019,350 | B2 * | 9/2011 | Purnhagen et al. | 455/450 |
| 8,208,641 | B2 * | 6/2012 | Oh et al. | 381/22 |
| 8,515,759 | B2 * | 8/2013 | Engdegard et al. | 704/258 |
| 2005/0226426 | A1 * | 10/2005 | Oomen et al. | 381/23 |
| 2006/0029329 | A1 | 2/2006 | Takushima et al. | |
| 2006/0165184 | A1 | 7/2006 | Purnhagen et al. | |
| 2008/0097750 | A1 | 4/2008 | Seefeldt et al. | |
| 2013/0094654 | A1 | 4/2013 | Breebaart et al. | |

FOREIGN PATENT DOCUMENTS

| | | | |
|---|---|---|---|
| JP | 2005-523480 | | 8/2005 |
| JP | 2006-337767 | | 12/2006 |
| JP | 2008-516290 | | 5/2008 |
| JP | 2008-543227 | | 11/2008 |
| RU | 2329548 | A | 7/2008 |
| RU | 2007111942 | C2 | 10/2008 |
| WO | WO2007/016107 | A2 | 2/2007 |

OTHER PUBLICATIONS

Faller, et al., "Binaural Cue Coding: A Novel and Efficient Representation of Spatial Audio", ICASSP, Orlando, FL, May 2002, 4 pages.

Faller, et al., "Estimation of auditory spatial cues for binaural cue coding", ICASSP, Orlando, FL, May 2002, 4 pages.

Faller, C et al., "Binaural cue coding applied to audio compression with flexible rendering", AES 113th Convention, Los Angeles, Preprint 5686, Oct. 2002.

Faller, C et al., "Efficient representation of spatial audio using perceptual parametrization,", IEEE WASPAA, Mohonk, NY, Oct. 2001, 4 pages.

ISO/IEC, , "Coding of Moving Pictures and Audio", ISO/IEC JTC 1/SS 29/WG 11 N753, Nice, France, Sections 5.2, 5.4.3, figure 7, Oct. 2005, 170 pages.

ISO/IEC, , "Information Technology—MPEG Audio Technologies—Part 1: MPEG Surround", ISO/IED FDIS 23003-1:2006(E), ISO/IEC JTC 1/SC 29/WG11, Jul. 21, 2006, 289 pages.

Schuijers, E et al., "Low Complexity Parametric Stereo Coding", AES 116'" Convention, Berlin, Preprint 6073, May 2004, 11 pages.

* cited by examiner

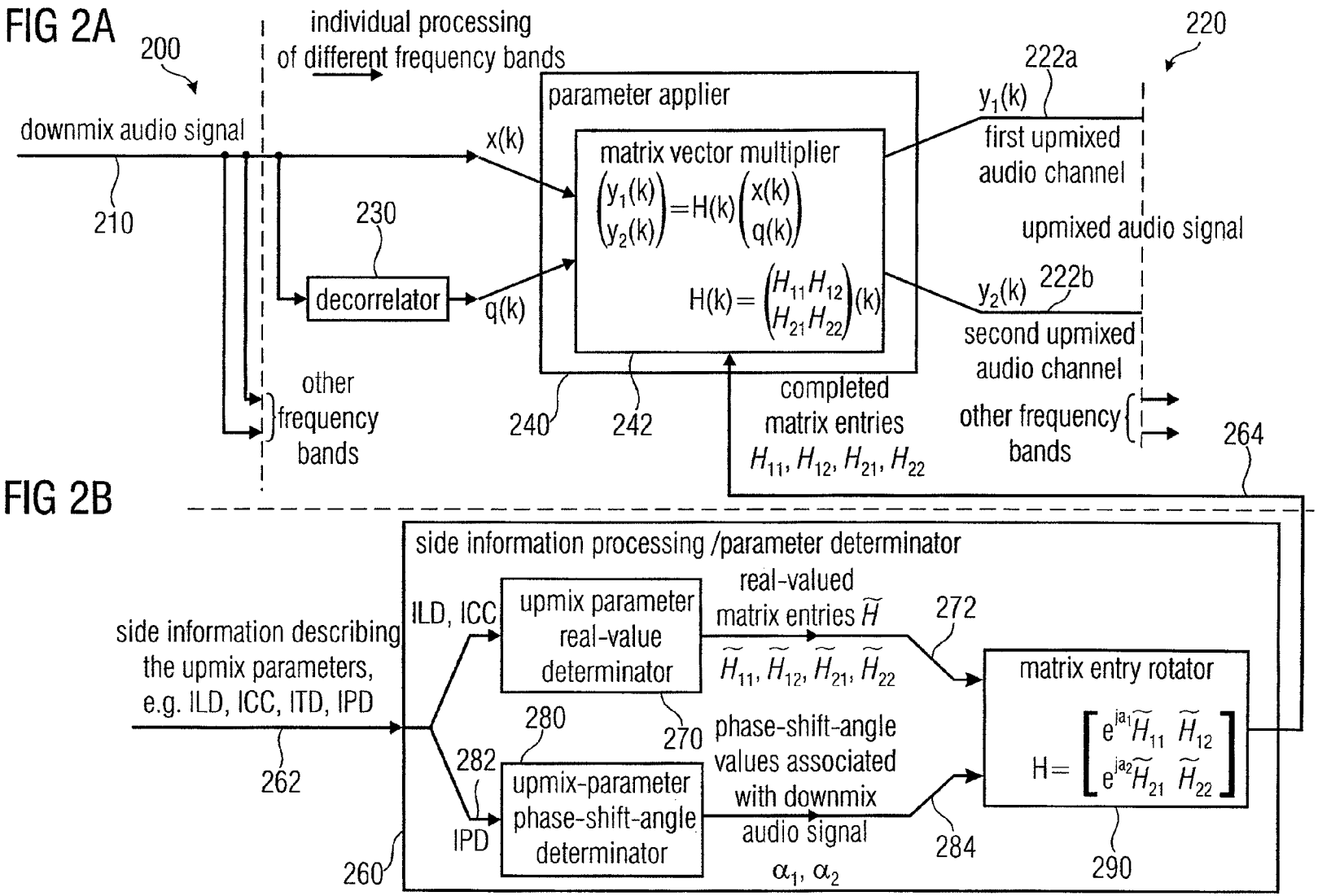
FIG 2A
200
downmix audio signal
210
individual processing of different frequency bands
x(k)
q(k)
230
decorrelator
other frequency bands
parameter applier
matrix vector multiplier
$\begin{pmatrix} y_1(k) \\ y_2(k) \end{pmatrix} = H(k) \begin{pmatrix} x(k) \\ q(k) \end{pmatrix}$
$H(k) = \begin{pmatrix} H_{11} & H_{12} \\ H_{21} & H_{22} \end{pmatrix}(k)$
240
242
completed matrix entries
$H_{11}, H_{12}, H_{21}, H_{22}$
220
upmixed audio signal
222a
$y_1(k)$
first upmixed audio channel
222b
$y_2(k)$
second upmixed audio channel
other frequency bands
264
FIG 2B
side information processing /parameter determinator
upmix parameter real-value determinator
ILD, ICC
270
real-valued matrix entries $\tilde{H}$
$\tilde{H}_{11}, \tilde{H}_{12}, \tilde{H}_{21}, \tilde{H}_{22}$
272
upmix-parameter phase-shift-angle determinator
280
IPD
282
phase-shift-angle values associated with downmix
audio signal
$\alpha_1, \alpha_2$
284
matrix entry rotator
$H = \begin{bmatrix} e^{j\alpha_1}\tilde{H}_{11} & \tilde{H}_{12} \\ e^{j\alpha_2}\tilde{H}_{21} & \tilde{H}_{22} \end{bmatrix}$
290
260
side information describing the upmix parameters, e.g. ILD, ICC, ITD, IPD
262

UPMIXER, METHOD AND COMPUTER PROGRAM FOR UPMIXING A DOWNMIX AUDIO SIGNAL

CROSS-REFERENCE TO RELATED APPLICATIONS

This application is a continuation of copending International Application No. PCT/EP2010/050287, filed Jan. 12, 2010, which is incorporated herein by reference in its entirety, and additionally claims priority from U.S. Application No. 61/147,810, filed Jan. 28, 2009, and from European Application No. EP 09012285.4, filed Sep. 28, 2009, which are incorporated herein by reference in their entirety.

BACKGROUND OF THE INVENTION

Embodiments according to the invention are related to an upmixer for upmixing a downmix audio signal into an upmixed audio signal describing one or more upmixed audio channels. Some embodiments according to the invention are related to a method and to a computer program for upmixing a downmix audio signal.

Some embodiments according to the invention are related to an improved phase processing for parametric multi-channel audio coding.

In the following, a short overview will be given and the context of the invention will be described. Recent developments in the area of parametric audio coding delivers techniques for jointly coding a multi-channel audio (e.g. 5.1) signal into one (or more) downmix channels plus a side information stream. These techniques are, for example, known as Binaural Cue Coding, Parametric Stereo, MPEG Surround, etc.

A number of publications describe the so-called "Binaural Cue Coding" parametric multi-channel coding approach, for example references [1], [2], [3], [4] and [5].

"Parametric Stereo" is a related technique for the parametric coding of a two-channel stereo signal based on a transmitted mono signal plus parameter side information. For details, reference is made to references [6] and [7].

"MPEG Surround" is an ISO (International Standardization Organization) standard for parametric multi-channel coding. For details, reference is made to reference [8].

These techniques are based on transmitting the relevant perceptual cues for human's spatial hearing in a compact form to the receiver together with the associated mono or stereo downmix-signal. Typical cues can be inter-channel level differences (ILD), inter-channel correlation or coherence (ICC) as well as inter-channel time differences (ITD) and inter-channel phase differences (IPD).

These parameters are transmitted in a frequency and time resolution adapted to the human's auditory resolution.

To recreate the properties of the original signal, the decoder may produce one or more decorrelated versions of the transmitted downmix signal. Additionally, a phase rotation of the output signals may be performed in the decoder to restore the original inter-channel phase relation.

Example Binaural Cue Coding System of FIG. 4

In the following, a generic binaural cue coding scheme will be described taking reference to FIG. 4. FIG. 4 shows a block schematic diagram of a binaural cue coding transmission system 400, which comprises a binaural cue coding encoder 410 and a binaural cue coding decoder 420. The binaural cue coding encoder 410 may for example receive a plurality of audio signals 412*a*, 412*b*, and 412*c*. Further, the binaural cue coding encoder 410 is configured to downmix the audio input signals 412*a*-412*c* using a downmixer 414 to obtain a downmix signal 416, which may for example be a sum signal. Further, the binaural cue coding encoder 410 may be configured to analyze the audio input signals 412*a*-412*c* using an analyzer 418 to obtain the side information signal 419. The sum signal 416 and the side information signal 419 are transmitted from the binaural cue coding encoder 410 to the binaural cue coding decoder 420. The binaural cue coding decoder 420 may be configured to synthesize a multi-channel audio output signal comprising, for example, audio channels y1, y2, . . . , $y_N$ on the basis of the sum signal 416 and inter-channel cues 424. For this purpose, the binaural cue coding decoder 420 may comprise binaural cue coding synthesizer 422 which receives the sum signal 416 and the inter-channel cues 424, and provides the audio signals y1, y2, . . . , $y_N$. The binaural cue coding decoder 420 further comprises a side information processor 426 which is configured to receive the side information 419 and, optionally, a user input 427. The side information processor 426 is configured to provide the inter-channel cues 424 on the basis of the side information 419 and the optional user input 427.

To summarize, the audio input signals are analyzed and downmixed in the BCC encoder 410. The sum signal plus the side information is transmitted to the BCC decoder 420. The inter-channel cues are generated from the side information and local user input. The binaural cue coding synthesis generates the multi-channel audio output signal.

For details, reference is made to the articles "Binaural Cue Coding Part II: Schemes and applications," by C. Faller and F. Baumgarte (published in: IEEE Transactions on Speech and Audio Processing, vol. 11, no. 6, November 2003).

Discussion of the Conventional Approaches

In the above-described approaches, it is difficult to appropriately control the inter-channel relation.

Accordingly, it is desirable to create a concept for upmixing a downmix signal, which provides a good accuracy with respect to an inter-channel correlation.

SUMMARY

According to an embodiment, an upmixer for upmixing a downmix audio signal into an upmixed audio signal describing one or more upmixed audio channels may have: a parameter applier configured to apply upmixing parameters to upmix the downmix audio signal in order to achieve the upmixed audio signal, wherein the parameter applier is configured to apply a phase shift to the downmix audio signal to achieve a phase-shifted version of the downmix audio signal while leaving a decorrelated signal unmodified by the phase shift, and to combine the phase-shifted version of the downmix audio signal with the decorrelated signal to achieve the upmixed audio signal.

According to another embodiment, an apparatus for achieving a set of upmix parameters for upmixing a downmix audio signal into an upmixed audio signal describing a plurality of upmixed audio channels may have: an upmix parameter real-value determinator configured to achieve real-valued upmix parameters describing a desired intensity of contributions of the downmix signal and of a decorrelated signal to the upmixed audio channel signals in dependence on one or more spatial cues representing the intensity of the contributions;

an upmix-parameter phase-shift-angle determinator configured to achieve one or more phase-shift-angle values describing a desired phase shift between downmix audio signal components in different upmixed audio channel signals in dependence on one or more spatial cues representing an inter-channel phase difference; and an upmix parameter rotator configured to rotate real-valued upmix parameters provided by the upmix parameter real-value determinator and intended to be applied to the downmix audio signal in dependence on the phase-shift-angle values, while leaving real-valued upmix parameters provided by the upmix parameter real-value determinator and intended to be applied to the decorrelated signal unaffected by the phase-shift-angle values, to achieve completed upmix parameters of the set of upmix parameters.

According to another embodiment, a method for upmixing a downmix audio signal into an upmixed audio signal describing one or more upmixed audio channels may have the steps of: applying upmixing parameters to upmix the downmix audio signal in order to achieve the upmixed audio signal; wherein applying upmixing parameters includes applying a phase shift to the downmix audio signal to achieve a phase-shifted version of the downmix audio signal while leaving a decorrelated signal unmodified by the phase shift; and wherein applying the upmixing parameters includes combining the phase-shifted version of the downmix audio signal with the decorrelated signal to achieve the upmixed audio signal.

According to another embodiment, a method for achieving a set of upmix parameters for upmixing a downmix audio signal into an upmixed audio signal describing a plurality of upmixed audio signals may have the steps of: achieving real-valued upmix parameters describing a desired intensity of contributions of the downmix signal and of the decorrelated signal to the upmixed audio channel signals in dependence on one or more spatial cues representing the intensity of the contribution; achieving phase-shift-angle values describing a desired phase shift between downmix audio signal components in different upmixed audio channel signals in dependence on one or more spatial cues representing an inter-channel phase difference; and rotating real-valued upmix parameters intended to be applied to the downmix audio signal in dependence on the phase-shift-angle values, while leaving real-valued upmix parameters intended to be applied to the decorrelated signal unaffected by the phase-shift-angle values, to achieve completed upmix parameters of the set of upmix parameters.

Another embodiment may have a computer program for performing a method for upmixing a downmix audio signal into an upmixed audio signal describing one or more upmixed audio channels, which method may have the steps of: applying upmixing parameters to upmix the downmix audio signal in order to achieve the upmixed audio signal; wherein applying upmixing parameters includes applying a phase shift to the downmix audio signal to achieve a phase-shifted version of the downmix audio signal while leaving a decorrelated signal unmodified by the phase shift; and wherein applying the upmixing parameters includes combining the phase-shifted version of the downmix audio signal with the decorrelated signal to achieve the upmixed audio signal, when the computer program runs on a computer.

Another embodiment may have a computer program for performing a method for achieving a set of upmix parameters for upmixing a downmix audio signal into an upmixed audio signal describing a plurality of upmixed audio signals, which method may have the steps of: achieving real-valued upmix parameters describing a desired intensity of contributions of the downmix signal and of the decorrelated signal to the upmixed audio channel signals in dependence on one or more spatial cues representing the intensity of the contribution; achieving phase-shift-angle values describing a desired phase shift between downmix audio signal components in different upmixed audio channel signals in dependence on one or more spatial cues representing an inter-channel phase difference; and rotating real-valued upmix parameters intended to be applied to the downmix audio signal in dependence on the phase-shift-angle values, while leaving real-valued upmix parameters intended to be applied to the decorrelated signal unaffected by the phase-shift-angle values, to achieve completed upmix parameters of the set of upmix parameters, when the computer program runs on a computer.

Embodiments according to the invention create an upmixer for upmixing a downmix audio signal into an upmixed audio signal describing one or more upmixed audio channels. The upmixer comprises a parameter applier configured to apply upmixing parameters to upmix the downmix audio signal in order to obtain the upmixed audio signal. The parameter applier is configured to apply a phase shift to the downmix audio signal, to obtain a phase-shifted version of the downmix audio signal, while leaving a decorrelated signal unmodified by the phase shift. The parameter applier is also configured to combine the phase-shifted version of the downmix audio signal with the decorrelated signal to obtain the upmix signal.

Some embodiments according to the invention are based on the finding that an inter-channel correlation between different upmixed audio signals is degraded by applying a phase shift (for example, a time-variable phase shift, which depends on spatial cues) to the decorrelated signal. Accordingly, it has been found that it is desirable to leave the decorrelated signal unmodified by the phase shift, which is applied to the downmix signal in order to obtain an appropriate inter-channel phase shift between different of the upmixed audio channels.

Accordingly, the improved phase processing according to the invention contributes to preventing incorrect output inter-channel correlation (of the upmixed audio channels), which would be caused by a phase-shifting of the decorrelated signal part.

In an advantageous embodiment, the upmixer is configured to obtain the decorrelated signal such that the decorrelated signal is a decorrelated version of the downmix audio signal. Thus, the decorrelated signal can easily be obtained from the downmix signal. However, in some other embodiments, different concepts may be used for obtaining the decorrelated signal. In a very simple solution, a noise signal may be used as the decorrelated signal.

In an advantageous embodiment, the upmixer is configured to upmix the downmix audio signal into an upmixed audio signal describing a plurality of upmixed audio channels. In this case, the parameter applier is configured to apply the upmixing parameters to upmix the downmix audio signal using the decorrelated signal in order to obtain a first upmixed audio channel signal and a second upmixed audio channel signal. The parameter applier is configured to apply a time-variant phase shift to the downmix audio signal to obtain at least two versions of the downmix audio signal comprising a time-variant phase shift with respect to each other. The parameter applier is also configured to combine the at least two versions of the downmix audio signal with the decorrelated signal to obtain the at least two upmixed audio channel signals such that the decorrelated signal remains unaffected by the time-variant phase shift. Accordingly, multiple channel signals of the upmixed audio signal can be obtained, wherein the decorrelated signal portions within the multiple upmixed channels (of the upmixed audio signal) are unaffected by relative phase shifts introduced between the correlated signal portions thereof. Consequently, the inter-channel correlation between the upmixed audio channels can be controlled with good precision.

In an embodiment, the parameter-applier is configured to combine the at least two versions of the downmix audio signal with the decorrelated signal such that a signal portion of the first upmixed audio channel signal representing the decorrelated signal and a signal portion of the second upmixed audio channel signal representing the decorrelated signal are in a temporally constant phase relationship, for example in-phase or 180° out-of-phase with respect to each other. Consequently, the signal portions representing the decorrelated signal can effectively serve to adjust the correlation of the upmixed audio channel signals. In contrast, if the signal portions representing the decorrelated signal would be arbitrarily or variably phase-shifted with respect to each other in the different upmixed audio channel signals, an adjustment of the desired inter-channel correlation would be degraded or even prevented.

In an embodiment according to the invention, the parameter-applier is configured to obtain the at least two versions of the downmix audio signal comprising a time-variant phase shift with respect to each other before combining the at least two versions of the downmix audio signal (comprising the time-variant phase shift with respect to each other) with the decorrelated signal, which decorrelated signal is left unaffected by the time-variant phase shift. By applying the time-variant phase shift before combining the result thereof with the decorrelated signal, the decorrelated signal is left unaffected by the time-variant phase shift. Consequently, the correlation characteristics of the resulting upmixed audio channel signals can be precisely adjusted.

In an embodiment according to the invention, the upmixer comprises a parameter determinator configured to determine the phase shift to be applied to the downmix audio signal on the basis of an inter-channel phase difference parameter. Accordingly, the phase shift is adapted to fit the desired human hearing impression.

In an embodiment according to the invention, the parameter-applier comprises a matrix-vector multiplier configured to multiply an input vector representing one or more samples of the downmix signal and one or more samples of the decorrelated signal with a matrix comprising matrix entries representing upmix parameters. The multiplication is performed to obtain, as a result, an output vector representing one or more samples of a first upmixed audio signal channel and one or more samples of a second upmixed audio signal channel. The upmixer comprises a parameter determinator configured to obtain the matrix entries on the basis of spatial cues associated with the downmix audio signal. The parameter determinator is configured to apply a time-varying phase rotation only to matrix entries to be applied to the one or more samples of the downmix signal, while leaving a phase of matrix entries to be applied to the one or more samples of the decorrelated signal unaffected by the time-varying phase rotation. By leaving some of the matrix entries, namely those which are applied to the decorrelated signal, unaffected by the time-varying phase rotation, an efficient implementation of the inventive concept can be obtained. The computational effort involved can be reduced by having some matrix elements, which comprise a fixed phase value (or which, for example, may be real-valued independent from the spatial cues). In addition, the determination of the matrix entries is naturally relatively simple if the phase values are constant.

In an embodiment, the matrix-vector multiplier is configured to receive the samples of the downmix audio signal and the samples of the decorrelated signal in a complex-valued representation. In addition, the matrix-vector multiplier is configured to apply complex-valued matrix entries to the input vector in order to apply a phase shift and to obtain the samples of the upmixed audio signal channels in a complex-valued representation. In this case, the parameter determinator is configured to compute real values or magnitude values of the matrix entries on the basis of inter-channel level difference parameters and/or inter-channel correlation parameters and/or inter-channel coherence parameters (or inter-channel correlation or coherence parameters) associated with the downmix audio signal. In addition, the parameter determinator is configured to compute phase values of matrix entries to be applied to the one or more samples of the downmix signal on the basis of inter-channel phase difference parameters associated with the downmix audio signal. Additionally, the parameter determinator is configured to apply a complex rotation to the magnitude values of the matrix entries to be applied to the one or more samples of the downmix signal in dependence on the corresponding phase values to obtain the matrix entries to be applied to the one or more samples of the downmix signal. Accordingly, an efficient multi-step determination of the matrix entries can be implemented. Real values or magnitude values of the matrix entries can be calculated without considering the inter-channel phase difference. Similarly, phase values of the matrix entries can be obtained without considering the inter-channel level difference parameters or inter-channel correlation/coherence parameters, which allows for an optional parallelization of the computations. In addition, the matrix entries can be efficiently adapted such that the inter-channel correlation of the upmixed audio channel signals can be adjusted with good precision.

An embodiment according to the invention creates a method for upmixing a downmix audio signal into an upmixed audio signal.

Another embodiment according to the invention comprises a computer program for performing the functionality of the inventive method.

BRIEF DESCRIPTION OF THE DRAWINGS

Embodiments according to the invention will subsequently be described taking reference to the enclosed Figs., in which:

FIG. 2 shows a detailed block schematic diagram of an upmixer for upmixing a downmix audio signal into an upmixed audio signal, according to another embodiment of the invention;

DETAILED DESCRIPTION OF THE INVENTION

Figure 1:
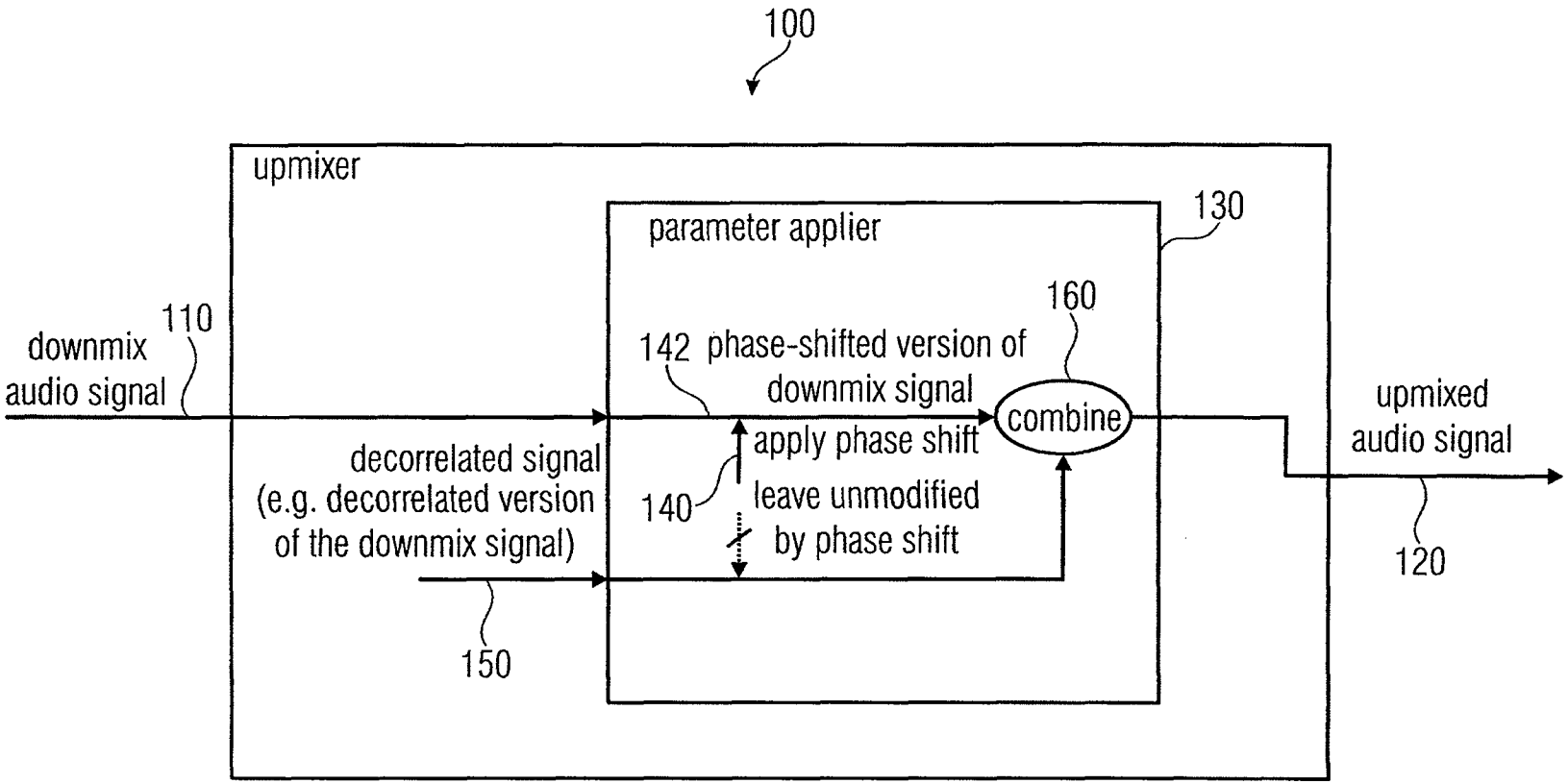
FIG. 1 shows a block schematic diagram of an upmixer for upmixing a downmix audio signal into an upmixed audio signal, according to an embodiment of the invention.

Embodiment According to FIG. 1

FIG. 1 shows a block schematic diagram of an upmixer 100 according to an embodiment of the invention. FIG. 1 shows the upmixing of a single channel for the sake of simplicity. Naturally, the concept disclosed herein can be applied in multi-channel systems as well, as will be described, for example, with reference to FIG. 2.

The upmixer 100 is configured to receive a downmix audio signal 110 and to upmix the downmix audio signal 110 into an upmixed audio signal 120 describing one or more upmixed audio channels.

The upmixer comprises a parameter-applier 130, which is configured to apply upmixing parameters to upmix the downmix audio signal 110 in order to obtain the upmixed audio signal 120. The parameter-applier 130 is configured to apply a phase shift (shown at reference numeral 140) to the downmix audio signal 110 to obtain a phase-shifted version 142 of the downmix audio signal 110, while leaving the decorrelated signal 150 unmodified by the phase shift. The parameter-applier 130 is further configured to combine (shown at reference numeral 160) the phase-shifted version 142 of the downmix audio signal 110 with the decorrelated signal 150 to obtain the upmixed audio signal 120.

By applying the phase shift only to the downmix audio signal 110, but not to the decorrelated signal 150 (which, for example, may be a decorrelated version of the downmix audio signal 110), the upmixed audio signal 120 comprises a decorrelated portion, wherein the decorrelated portion of the upmixed audio signal 120 is based on the decorrelated signal 150, and wherein the phase of the decorrelated portion is left unaffected by the phase shift applied to the downmix audio signal 110. Accordingly, a signal portion of the upmixed audio signal 120 which is correlated with the downmix audio signal 110 is phase-shifted (e.g. in a time-varying manner) in dependence on the applied phase shift, while a portion of the upmixed audio signal 120 which is decorrelated from the downmix audio signal 110 is left unaffected by the phase shift. Accordingly, an adjustment of the inter-channel correlation characteristics of the upmixed audio signal (with respect to further upmixed audio signals) can be performed with high precision without having the requirement to consider the time-varying phase shifts applied to the downmix audio signal.

Embodiment According to FIGS. 2*a* and 2*b*

FIGS. 2*a* and 2*b* show a detailed block schematic diagram of an apparatus 200 according to another embodiment of the invention.

The apparatus 200 is configured to receive a downmix audio signal 210 and to upmix the downmix audio signal 210 into an upmixed audio signal 220. The upmixed audio signal 220 may, for example, describe a first upmixed audio channel 222*a* and a second upmixed audio channel 222*b*.

The downmix audio signal 210 may, for example, be a sum signal provided by a spatial audio encoder (for example, the sum signal 416 provided by the binaural cue coding encoder 410). The downmix audio signal 210 may, for example, be represented in the form of a complex-valued frequency decomposition. For example, the downmix audio signal may comprise one sample in every frequency band (out of a plurality of frequency bands) for every audio sample update interval (indicated by temporal index k).

In the following, the processing of samples in one frequency band will be described. However, audio samples in other frequency bands can be processed similarly. In other words, in some embodiments according to the invention, different frequency bands may be processed independently.

Similarly, it is assumed that the first upmixed audio channel signal 222*a* represents, in the form of complex-valued samples, an audio content in a specific frequency band of the upmixed audio signal 220. Likewise, it is assumed that the second upmixed audio channel signal 222*b* represents, in the form of complex-valued samples, the audio content in the specific frequency band under consideration. Upmixed audio channel signals for different frequency bands may be obtained, however, according to the same concept described herein.

The frequency band processing (i.e. the generation of an upmix signal for a single frequency band) of the apparatus 200 is therefore configured to receive a stream x(k) describing a sequence of subsequent, complex-valued samples of an audio content of the frequency band under consideration. In this notation, k serves as a time index. In the following, x(k) will be briefly designated as "downmix audio signal", keeping in mind that x(k) merely describes the audio content of the single frequency band under consideration of the overall (multi-frequency band) downmix audio signal.

The frequency band processing comprises a decorrelator 230, which is configured to receive the downmix audio signal x(k) and to provide, on the basis thereof, a decorrelated version q(k) of the downmix audio signal x(k). The decorrelated version q(k) may be represented by a sequence of complex-valued samples. The frequency band processing also comprises a parameter-applier 240, which is configured to receive the downmix audio signal x(k) and the decorrelated version q(k) of the downmix audio signal and to provide, on the basis thereof, the first upmixed audio channel signal 222*a* and the second upmixed audio channel signal 222*b*.

In the embodiment of FIG. 2, the parameter-applier 240 comprises a matrix vector multiplier 242 (or any other appropriate means), which is configured to perform a weighted linear combination of the downmix audio signal x(k) and the decorrelated version q(k) of the downmix audio signal to obtain the upmixed audio channel signals 222*a*, 222*b*. The weighting of x(k) and q(k) is determined by entries of a weighting matrix H(k), wherein the entries of the weighting matrix may be time-variant (i.e. dependent from the time index k). In general, some of the entries of the weighting matrix H(k) may be complex-valued, as will be discussed in detail in the following.

In the embodiment of FIG. 2, a sample $y_1(k)$ of the first upmixed audio channel signal 222*a* may be obtained by adding a sample x(k) of the downmix audio signal, weighted by a complex-valued matrix entry $H_{11}$, and a temporarily corresponding sample q(k) of the decorrelated signal, weighted with a (typically, but not necessarily, real-valued) matrix entry $H_{12}$. Similarly, a sample $y_2(k)$ of the second upmixed audio channel signal 222*b* is obtained by adding a sample x(k) of the downmix audio signal, weighted by a complex-valued matrix entry $H_{21}$, and a temporarily corresponding sample q(k) of the decorrelated signal, weighted with a (typically real-valued) matrix entry $H_{22}$.

Accordingly, a phase shift or phase rotation is applied to the samples x(k) of the (correlated) downmix audio signal when deriving there-from samples $y_1(k)$, $y_2(k)$ of the upmixed audio channel signals 222*a*, 222*b*. In contrast, the application of a phase shift or phase rotation is avoided when calculating the contribution of the samples q(k) of the decorrelated signal to the samples of the upmixed audio channel signals 222*a*, 222*b*.

In the following, it will be described how the matrix entries $H_{11}$, $H_{12}$, $H_{21}$, $H_{22}$ of the matrix H can be obtained.

For this purpose, the apparatus 200 comprises a side information-processing unit 260, which is configured to receive a side information 262 describing the upmix parameters. The side information 262 may, for example, comprise spatial cues like, for example, inter-channel level difference parameters, inter-channel correlation or coherence parameters, inter-channel time difference parameters or inter-channel phase difference parameters. Said parameters ILD, ICC, ITD, IPD are well-known in the art of spatial coding and will not be described in detail here.

The side information-processing unit 260 is configured to provide the (completed) matrix entries $H_{11}$, $H_{12}$, $H_{21}$, $H_{22}$ to the matrix vector multiplier 242 (which is shown at reference numeral 264). The side information-processing unit 260 can therefore also be considered as a "parameter determinator".

The side information processing unit 260 comprises an upmix parameter real-value determinator 270, which is configured to receive spatial cues describing an amplitude relationship or power relationship between different signal components in the upmixed audio channel signals 222*a*, 222*b*. For example, the upmix parameter real-value determinator 270 is configured to receive inter-channel level difference parameters and/or inter-channel correlation or coherence parameters. The upmix parameter real-value determinator 270 is configured to provide, on the basis of said spatial cues (e.g. ILD, ICC), real-valued matrix entries. The Upmix parameter real-value determinator 270 is configured to provide the real-valued matrix entries $\tilde{H}_{11}$, $\tilde{H}_{12}$ $\tilde{H}_{21}$, $\tilde{H}_{22}$ on the basis of the received spatial cues (e.g. ILD, ICC). The real-valued matrix entries are designated with 272. As the computation of the real-valued matrix entries 272 is well-known in the art of spatial decoding, a detailed description will be omitted here. Rather, reference is made to the documents cited under the section entitled "References" and to any other publications well known to the man skilled in the art.

The side information processing unit 260 further comprises an upmix parameter phase-shift-angle determinator 280, which is configured to receive spatial cues representing a phase shift between different signal components of the upmixed audio channel signals 222*a*, 222*b*. For example, the upmix parameter phase-shift-angle determinator 280 is configured to receive inter-channel phase difference parameters 282. The Upmix parameter phase-shift-angle determinator 280 is also configured to provide phase-shift-angle values $\alpha_1$, $\alpha_2$ associated with the downmix audio signal, which are also designated with 284. The computation of phase-shift-angle values on the basis of the inter-channel phase difference parameters 282 is well-known in the art, such that a detailed description is omitted here. Reference is made, for example, to the documents cited under section "References", and also to any other publications well-known to the man skilled in the art.

The side information processing unit 260 further comprises a matrix entry rotator 290, which is configured to receive the real-valued matrix entries 272 and the phase-shift-angle values 284 and to compute, on the basis thereof, the (completed) matrix entries of the matrix H (also designated with H(k) to indicate the time-dependency). For this purpose, the matrix entry rotator 290 may be configured to apply the phase shift angle values $\alpha_1$, $\alpha_2$ to those (and, advantageously, only those) real-valued matrix entries 272, which are intended for application to downmix audio signal x(k). In contrast, the matrix entry rotator 290 is advantageously configured to leave those real-valued matrix entries, which are intended to be applied to samples of decorrelated signal q(k), unaffected by the phase-shift-angle values $\alpha_1$, $\alpha_2$. Consequently, those matrix entries, which are intended to be applied (by the matrix-vector multiplier 242) to samples of the decorrelated signal q(k) remain real values, as provided by the upmix parameter real-value determinator 270. However, in some embodiments, the inversion of the sign may occur.

In the embodiment shown in FIG. 2, the following relations may hold:

$$H_{11}=e^{j\alpha_1}\tilde{H}_{11}$$

$$H_{12}=\tilde{H}_{12}$$

$$H_{21}=e^{j\alpha_2}\tilde{H}_{21}$$

$$H_{22}=\tilde{H}_{22}$$

Accordingly, the matrix entry rotator 290 is configured to derive the (completed) matrix entries of the matrix H and to provide these (completed) matrix entries to the matrix-vector multiplier 242.

As usual, the matrix entries of the matrix H may be updated during the operation of the apparatus 200. For example, the matrix entries 264 of the matrix H may be updated whenever a new set of side information 262 is received by the apparatus 200. In other embodiments, interpolation may be performed. Thus, the matrix entries 264 may be updated once per audio sample update interval k in some embodiments wherein an interpolation may be applied.

In the following, the concept according to the present invention which has been described in detail with reference to FIGS. 2*a* and 2*b*, will be briefly summarized. Embodiments according to the invention enhance upmixing techniques by an improved phase processing, which prevents incorrect output inter-channel correlation caused by phase shifting of the decorrelated signal part.

For simplicity, the embodiment shown in FIG. 2 and also the following description restricts to an upmix from one to two channels only. The decoder's upmix procedure from e.g. one to two channels is carried out by a matrix multiplication of a vector consisting of the downmix signal x, called the "dry signal", and a decorrelated version of the downmix signal q, called the "wet signal", with an upmix matrix H. The wet signal q may be generated by feeding the downmix signal x through a decorrelation filter (e.g. in the form of the decorrelator 230). The output signal y is a vector containing the first and second channel of the output (for example, the first upmix audio channel signal 222*a* and the second upmix audio channel 222*b*).

All signals x, q, y may be available in a complex-valued frequency decomposition. The matrix operation may be performed for all subband samples of every frequency band. The following matrix operation may be performed:

$$\begin{bmatrix} y_1 \\ y_2 \end{bmatrix} = H \begin{bmatrix} x \\ q \end{bmatrix}$$

The said matrix operation, which may be performed by the matrix-vector multiplier 242, is also shown in FIG. 2, wherein the time index k indicates that the input samples x, y, the upmixed output samples $y_1$, $y_2$ and also the upmix matrix H are typically time-varying.

The coefficients (or matrix entries) $H_{11}$, $H_{12}$, $H_{21}$, $H_{22}$ of the upmix matrix H are derived from the spatial cues, for example using the side information processing unit 260. The matrix operation (which is performed by the matrix-vector multiplier 242) applies a mixing of the dry signal x and the wet signal q according to the ICCs and weighting of the output channels 222*a*, 222*b* according to the ILDs. By using complex-valued coefficients, an additional phase shift according to the IPDs can be applied (as will be described in the following).

The wet signal q is created by passing the downmix signal x through a decorrelation filter (for example, the decorrelator 230), which is designed in a way that the correlation between x and q is sufficiently close to zero. To recreate the original degree of correlation between the two channels, which is described by the transmitted ICCs, the signals x and q are mixed differently for the two output channels 222*a*, 222*b*. The mixing coefficients (e.g. the matrix entries of the matrix H) are calculated in a way that the correlation of the output channels matches the transmitted ICCs.

The phase relation between the two channels, which is described by the transmitted IPDs, is recreated by applying phase shifts to the output signals. The two signals are generally rotated by different angles.

Conventional decoders apply the phase shifts to the complete output signals, which means that both the dry and wet signal components are processed.

The transmitted IPDs describe the difference of phase angle between the two channels. It has been found that, as no phase difference can be defined for uncorrelated signals, the IPD values are based on the correlated signal components. It has been found that, therefore, it is not necessary to apply the phase rotation to the wet signal part of the output channels. Further, it has been found that the application of different phase shifts to the two channels (comprising the decorrelated signal portions) can even result in a wrong degree of output correlation, as the computation of dry and wet mixing may be based on the assumption that the same decorrelated signal is mixed into both channels.

A common approach for mixing of dry and wet signals is to mix the same amount of wet signal to both channels with different signs. It has been found that, if different phase shifts are applied to the output channels (e.g. after combining the dry signal x and the wet signal q), this out-of-phase property of the wet signal part is destroyed, resulting in a loss of decorrelation.

In contrast, the inventive solution helps to maintain the desired degree of decorrelation.

In the following, further details regarding the embodiment described above will be explained. In an embodiment according to the invention, a modified upmix (when compared to conventional upmix techniques) is used to avoid a loss of decorrelation by this rotation according to inter-channel phase differences (IPDs). As described above, it has been found that a phase shift of the wet signal part can result in a loss of decorrelation and is not necessary for reconstruction of the original phase relation between channels. When applying the phase shift in the upmix matrix H using complex coefficients, the processing can be limited to the dry signal by only rotating those coefficients multiplied with the dry signal.

In the following, a method will be described, which can be used for obtaining the upmix matrix H or upmix parameters (for example, entries of the upmix matrix H).

In a first step, the real-valued matrix $\tilde{H}$ (or the entries thereof) is computed from the transmitted inter-channel level differences (ILDs) and inter-channel correlation or coherence parameters (ICCs), which spatial cues may be received by the apparatus 200 as a part of the side information 262. This computation (which may be performed by the upmix parameter real-value determinator 270) may be done in the same way as if no inter-channel phase differences (IPDs) would be used.

In a next step (which may optionally be performed in parallel with the first step, or even before the "first step"), the phase shift angles for the, for example, two output channels $\alpha_1$ and $\alpha_2$ are calculated in (for example, in the upmix parameter phase shift angle determinator 280) from the transmitted IPDs, as usual.

Finally, a complex rotation of those elements (or entries) of the matrix $\tilde{H}$, which are multiplied with the dry signal, i.e. the first column of the matrix, is performed to obtain the upmix matrix H (for example, using the matrix entry rotator 290):

$$H = \begin{bmatrix} e^{j\alpha_1}\tilde{H}_{11} & \tilde{H}_{12} \\ e^{j\alpha_2}\tilde{H}_{21} & \tilde{H}_{22} \end{bmatrix}$$

Using this modified upmix matrix, phase rotation is only applied to the dry signals part (for example, by the matrix-vector multiplier 242 applying the matrix H), while the wet signal part is not modified and correct decorrelation is preserved.

Figure 3A:
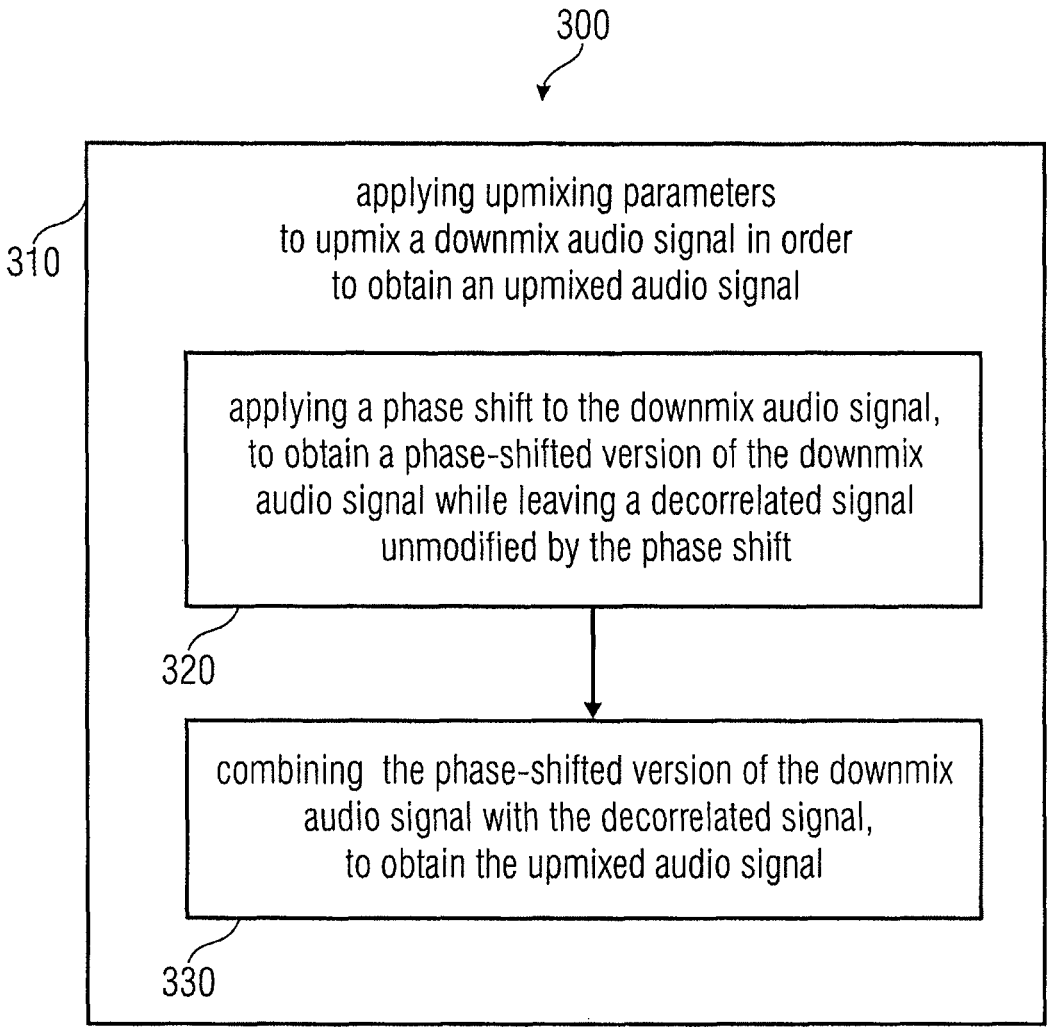
FIG. 3*a* shows a flow chart of a method for upmixing a downmix audio signal into an upmixed audio signal, according to an embodiment of the invention.

Method According to FIG. 3*a*

FIG. 3*a* shows a flow chart of a method 300 for upmixing a downmix audio signal into an upmixed audio signal describing one or more upmixed audio channels. The method 300 generally comprises applying 310 upmixing parameters to upmix the downmix audio signal in order to obtain the upmixed audio signal. Applying 310 upmixing parameters comprises a step 320 of applying a phase shift to the downmix audio signal to obtain a phase-shifted version of the downmix audio signal, while leaving a decorrelated signal, unmodified by the phase shift. Applying 310 upmixing parameters further comprises a step 330 of combining the phase-shifted version of the downmix audio signal with the decorrelated signal, to obtain the upmixed audio signal.

It should be noted that the method 300 can be supplemented by any of the functionalities described herein, also with respect to the inventive apparatus.

Figure 3B:
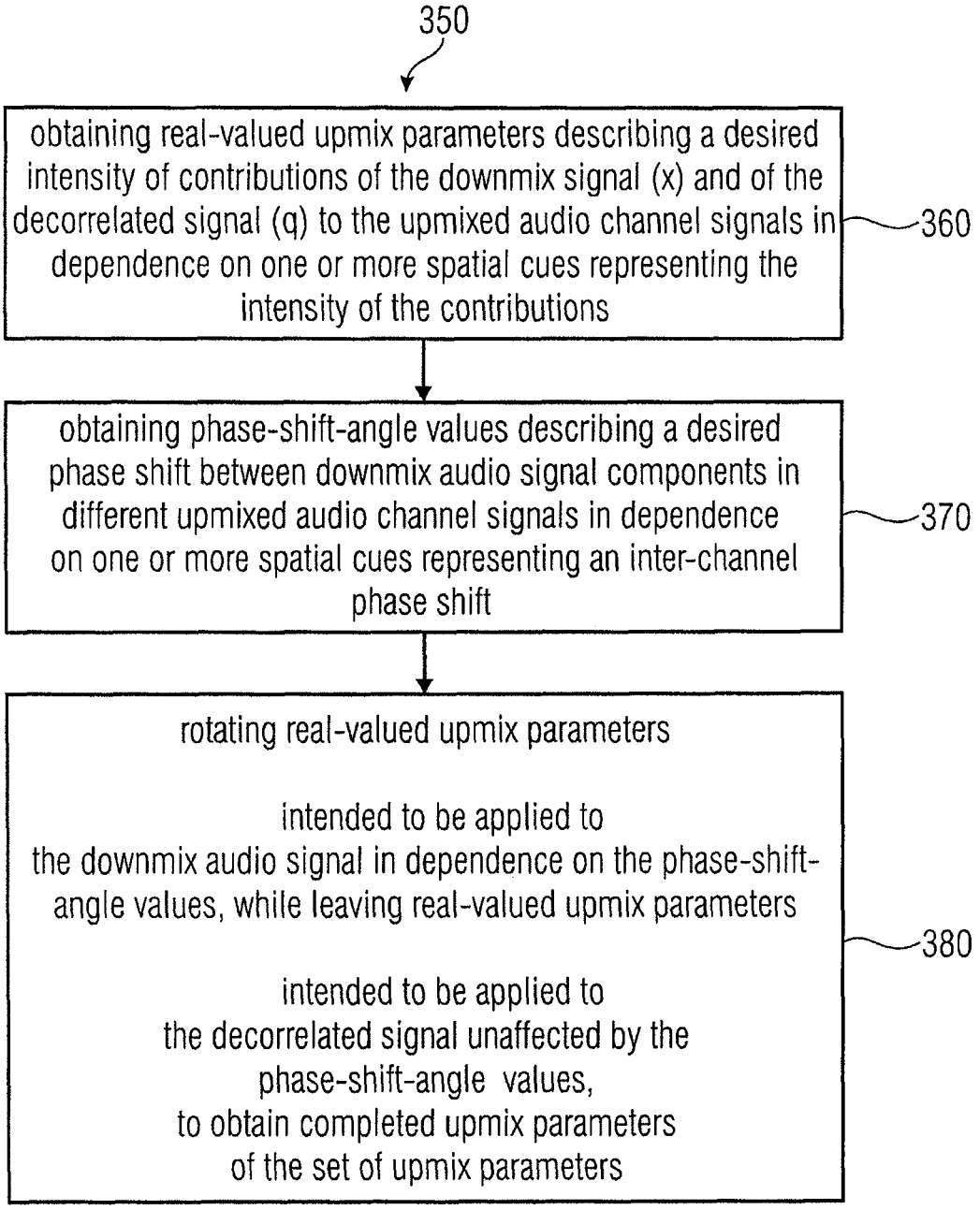
FIG. 3*b* shows a block schematic diagram of a method for obtaining a set of upmix parameters, according to an embodiment of the invention.
Figure 4:
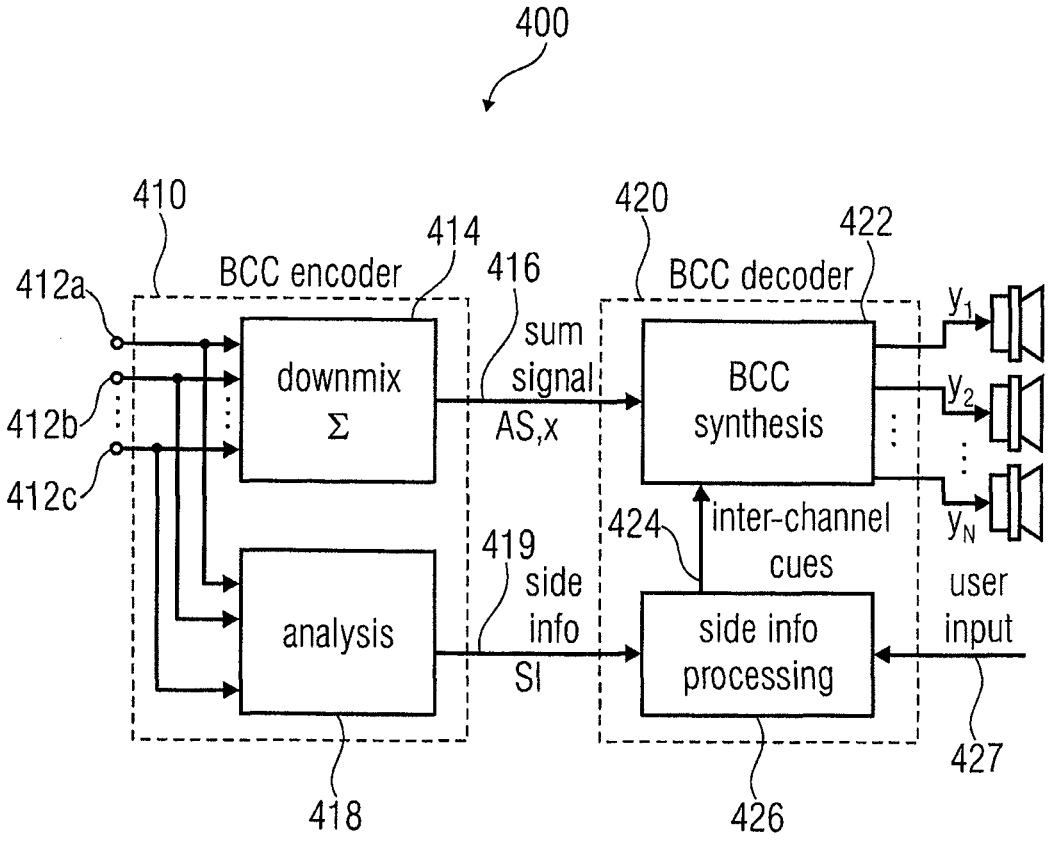
FIG. 4 shows a block schematic diagram of a conventional generic binaural cue coding scheme.

Method According to FIG. 3*b*

FIG. 3*b* shows a method 350 for obtaining a set of upmix parameters, according to an embodiment of the invention. The method 350 comprises a first step 360 of obtaining real-valued upmix parameters (for example, real-valued matrix entries) describing a desired intensity of contributions of the downmix signal (e.g. the signal x) and of the decorrelated signal (e.g. the signal q) to the upmixed audio channel signals (e.g. $y_1$, $y_2$) in dependence on one or more spatial cues (e.g. ILD, ICC) representing the intensity of the contributions. The method 350 further comprises a second step 370 of obtaining phase-shift-angle values (e.g. $\alpha_1$, $\alpha_2$) describing a desired phase shift between downmix audio signal components in different upmixed audio channel signals (e.g. $y_1$, $y_2$) in dependence on one or more spatial cues representing an inter-channel phase shift (e.g. IPD). The method 350 further comprises a step 380 of rotating (i.e. phase-shifting) real-valued upmix parameters intended to be applied to the downmix audio signal in dependence on the phase-shift-angle values, while leaving real-valued upmix parameters, intended to be applied to the decorrelated signal, unaffected by the phase-shift-angle values, to obtain completed upmix parameters of the set of upmix parameters.

The method 350 can be supplemented by any of the features and functionalities described herein, also with respect to the inventive apparatus.

Computer Program Implementation

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier. In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein. Al A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein.

CONCLUSION

To summarize the above, an improved upmixing method for recreating the original inter-channel phase difference while preserving correct decorrelation has been described. Embodiments according to the invention supersede other techniques by preventing a loss of decorrelation in the output signal caused by an undesired phase processing of the decorrelator output.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] C. Faller and F. Baumgarte, "Efficient representation of spatial audio using perceptual parameterization," IEEE WASPAA, Mohonk, N.Y., October 2001.

[2] F. Baumgarte and C. Faller, "Estimation of auditory spatial cues for binaural cue coding," ICASSP, Orlando, Fla., May 2002.

[3] C. Faller and F. Baumgarte, "Binaural cue coding: a novel and efficient representation of spatial audio," ICASSP, Orlando, Fla., May 2002.

[4] C. Faller and F. Baumgarte, "Binaural cue coding applied to audio compression with flexible rendering," AES 113th Convention, Los Angeles, Preprint 5686, October 2002.

[5] C. Faller and F. Baumgarte, "Binaural Cue Coding—Part II: Schemes and applications," IEEE Trans. on Speech and Audio Proc., vol. 11, no. 6, November 2003.

[6] J. Breebaart, S. van de Par, A. Kohlrausch, E. Schuijers, "High-Quality Parametric Spatial Audio Coding at Low Bitrates", AES 116th Convention, Berlin, Preprint 6072, May 2004.

[7] E. Schuijers, J. Breebaart, H. Purnhagen, J. Engdegard, "Low Complexity Parametric Stereo Coding", AES 116th Convention, Berlin, Preprint 6073, May 2004.

[8] ISO/IEC JTC 1/SC 29/WG 11, 23003-1, MPEG Surround.

[9] J. Blauert, Spatial Hearing: The Psychophysics of Human Sound Localization, The MIT Press, Cambridge, Mass., revised edition 1997.

The invention claimed is:

1. An upmixer for upmixing a downmix audio signal into an upmixed audio signal describing one or more upmixed audio channels, the upmixer comprising:

a parameter applier configured to apply upmixing parameters to upmix the downmix audio signal in order to achieve the upmixed audio signal, wherein the parameter applier is configured to apply a phase shift to the downmix audio signal to achieve a phase-shifted version of the downmix audio signal while leaving a decorrelated signal unmodified by the phase shift, and to combine the phase-shifted version of the downmix audio signal with the decorrelated signal to achieve the upmixed audio signal;

wherein the upmixer is configured to upmix the downmix audio signal into an upmixed audio signal describing a plurality of upmixed audio channels, wherein the parameter applier is configured to apply the upmixing parameters to upmix the downmix audio signal using the decorrelated signal in order to achieve a first upmixed audio channel signal and a second upmixed audio channel signal, wherein the parameter applier is configured to apply a time-variant phase shift to the downmix audio signal to achieve at least two versions of the downmix audio signal comprising a time-variant phase shift with respect to each other; and wherein the parameter applier is configured to combine the at least two versions of the downmix audio signal with the decorrelated signal to achieve at least two upmixed audio channel signals such that the decorrelated signal remains unaffected by the time-variant phase shift;

wherein the upmixer is implemented using a hardware apparatus, or using a computer, or using a combination of a hardware apparatus and a computer.

2. The upmixer according to claim 1, wherein the upmixer is configured to achieve the decorrelated signal such that the decorrelated signal is a decorrelated version of the downmix audio signal.

3. The upmixer according to claim 1, wherein the parameter applier is configured to combine the at least two versions of the downmix audio signal with the decorrelated signal, such that a signal portion of the first upmixed audio channel signal representing the decorrelated signal and a signal portion of the second upmixed audio channel signal representing the decorrelated signal are in a temporally constant phase relationship.

4. The upmixer according to claim 1, wherein the parameter applier is configured to combine the at least two versions of the downmix audio signal with the decorrelated signal, such that a signal portion of the first upmixed audio channel signal representing the decorrelated signal and a signal portion of the second upmixed audio channel signal representing the decorrelated signal are in-phase or 180° out-of-phase with respect to each other.

5. The upmixer according to claim 1, wherein the parameter applier is configured to achieve the at least two versions of the downmix audio signal comprising a time-variant phase shift with respect to each other before combining the at least two versions of the downmix audio signal with the decorrelated signal, which decorrelated signal is left unaffected by the time-variant phase shift.

6. The upmixer according to claim 1, wherein the upmixer comprises a parameter determinator configured to determine the phase shift on the basis of an inter-channel phase difference parameter.

7. An upmixer for upmixing a downmix audio signal into an upmixed audio signal describing one or more upmixed audio channels, the upmixer comprising:

a parameter applier configured to apply upmixing parameters to upmix the downmix audio signal in order to achieve the upmixed audio signal, wherein the parameter applier is configured to apply a phase shift to the downmix audio signal to achieve a phase-shifted version of the downmix audio signal while leaving a decorrelated signal unmodified by the phase shift, and to combine the phase-shifted version of the downmix audio signal with the decorrelated signal to achieve the upmixed audio signal;

wherein the parameter applier comprises a matrix-vector multiplier configured to multiply an input vector representing one or more samples of the downmix audio signal and one or more samples of the decorrelated signal with a matrix comprising matrix entries representing the upmix parameters to achieve, as a result, an output vector representing one or more samples of a first upmixed audio channel signal and one or more samples of a second upmixed audio channel, and wherein the upmixer comprises an upmix parameter determinator configured to achieve the matrix entries on the basis of spatial cues associated with the downmix audio signal, and wherein the upmix parameter determinator is configured to apply a time-variant phase rotation only to matrix entries to be applied to one or more samples of the downmix signal, while leaving a phase of matrix entries to be applied to the one or more samples of the decorrelated signal unaffected by the time-variant phase rotation;

wherein the upmixer is implemented using a hardware apparatus, or using a computer, or using a combination of a hardware apparatus and a computer.

8. The upmixer according to claim 7, wherein the matrix-vector multiplier is configured to receive the samples of the downmix audio signal and the samples of the decorrelated signal in a complex-valued representation;

wherein the matrix-vector-multiplier is configured to apply complex-valued matrix entries to one or more entries of the input vector in order to apply a phase shift, to achieve the samples of the upmixed audio channels in a complex-valued representation; and wherein the upmix parameter determinator is configured to compute real values or magnitude values of the matrix entries on the basis of inter-channel level difference parameters, inter-channel correlation parameters or inter-channel coherence parameters associated with the downmix audio signal, to compute phase values of matrix entries to be applied to the one or more samples of the downmix signal on the basis of inter-channel phase difference parameters associated with the downmix audio signal, and to apply a complex rotation to the real values or magnitude values of the matrix entries to be applied to the one or more samples of the downmix signal in dependence on the corresponding phase values to achieve the matrix entries to be applied to the one or more samples of the downmix signal.

9. The upmixer according to claim 7, wherein the matrix-vector multiplier is configured to achieve the output vector $$y = \begin{bmatrix} y_1 \\ \vdots \\ y_i \\ \vdots \\ y_N \end{bmatrix}$$

according to the equation $$y = \begin{bmatrix} e^{j\alpha_1}\tilde{H}_{11} & \tilde{H}_{12} \\ \vdots & \vdots \\ e^{j\alpha_i}\tilde{H}_{i1} & \tilde{H}_{i2} \\ \vdots & \vdots \\ e^{j\alpha_N}\tilde{H}_{N1} & \tilde{H}_{N2} \end{bmatrix} \begin{bmatrix} x \\ q \end{bmatrix}$$

wherein $y_i$ designates a complex-valued sample of an i-th upmixed audio channel;

$\alpha_i$ designates a phase value associated with the i-th upmixed audio channel;

$\tilde{H}_{i1}$ designates a real-valued magnitude value describing a contribution of the downmix audio signal to the i-th upmixed audio channel;

$\tilde{H}_{i2}$ designates a real-valued magnitude value describing a contribution of the decorrelated signal q to the i-th upmix audio channel;

j designates an imaginary unit;

x designates a sample of the downmix audio signal;

q designates a sample of the decorrelated signal; and $e^{-}$ designates an exponential function.

10. An apparatus for achieving a set of upmix parameters for upmixing a downmix audio signal into an upmixed audio signal describing a plurality of upmixed audio channels, the apparatus comprising:

an upmix parameter real-value determinator configured to achieve real-valued upmix parameters describing a desired intensity of contributions of the downmix signal and of a decorrelated signal to the upmixed audio channel signals in dependence on one or more spatial cues representing the intensity of the contributions;

an upmix-parameter phase-shift-angle determinator configured to achieve one or more phase-shift-angle values describing a desired phase shift between downmix audio signal components in different upmixed audio channel signals in dependence on one or more spatial cues representing an inter-channel phase difference; and an upmix parameter rotator configured to rotate real-valued upmix parameters provided by the upmix parameter real-value determinator and intended to be applied to the downmix audio signal in dependence on the phase-shift-angle values, while leaving real-valued upmix parameters provided by the upmix parameter real-value determinator and intended to be applied to the decorrelated signal unaffected by the phase-shift-angle values, to achieve completed upmix parameters of the set of upmix parameters;

wherein the apparatus is implemented using a hardware apparatus, or using a computer, or using a combination of a hardware apparatus and a computer.

11. The apparatus according to claim 10, wherein the set of upmix parameters is represented by an upmix matrix;

wherein the real-valued upmix parameters are real-valued matrix entries; and wherein the completed upmix parameters are completed matrix entries; and wherein the apparatus is configured to achieve the completed upmix parameters such that upmix parameters to be applied to the downmix signal comprise a phase which is dependent on spatial cues received by the apparatus, while upmix parameters to be applied to the decorrelated signal comprise a predetermined phase value which is independent from the spatial cues.

12. A method for upmixing a downmix audio signal into an upmixed audio signal describing one or more upmixed audio channels, the method comprising:

applying upmixing parameters to upmix the downmix audio signal in order to achieve the upmixed audio signal;

wherein applying upmixing parameters comprises applying a phase shift to the downmix audio signal to achieve a phase-shifted version of the downmix audio signal while leaving a decorrelated signal unmodified by the phase shift; and wherein applying the upmixing parameters comprises combining the phase-shifted version of the downmix audio signal with the decorrelated signal to achieve the upmixed audio signal;

wherein the downmix audio signal is upmixed into an upmixed audio signal describing a plurality of upmixed audio channels, wherein the upmixing parameters are applied to upmix the downmix audio signal using the decorrelated signal in order to achieve a first upmixed audio channel signal and a second upmixed audio channel signal, wherein a time-variant phase shift is applied to the downmix audio signal to achieve at least two versions of the downmix audio signal comprising a time-variant phase shift with respect to each other; and wherein the at least two versions of the downmix audio signal are combined with the decorrelated signal to achieve at least two upmixed audio channel signals such that the decorrelated signal remains unaffected by the time-variant phase shift.

13. A method for achieving a set of upmix parameters for upmixing a downmix audio signal into an upmixed audio signal describing a plurality of upmixed audio signals, the method comprising:

achieving real-valued upmix parameters describing a desired intensity of contributions of the downmix signal and of the decorrelated signal to the upmixed audio channel signals in dependence on one or more spatial cues representing the intensity of the contribution;

achieving phase-shift-angle values describing a desired phase shift between downmix audio signal components in different upmixed audio channel signals in dependence on one or more spatial cues representing an inter-channel phase difference; and rotating real-valued upmix parameters intended to be applied to the downmix audio signal in dependence on the phase-shift-angle values, while leaving real-valued upmix parameters intended to be applied to the decorrelated signal unaffected by the phase-shift-angle values, to achieve completed upmix parameters of the set of upmix parameters.

14. A non-transitory computer readable medium comprising a computer program for performing a method for upmixing a downmix audio signal into an upmixed audio signal describing one or more upmixed audio channels, the method comprising:

applying upmixing parameters to upmix the downmix audio signal in order to achieve the upmixed audio signal;

wherein applying upmixing parameters comprises applying a phase shift to the downmix audio signal to achieve a phase-shifted version of the downmix audio signal while leaving a decorrelated signal unmodified by the phase shift; and wherein applying the upmixing parameters comprises combining the phase-shifted version of the downmix audio signal with the decorrelated signal to achieve the upmixed audio signal, wherein the downmix audio signal is upmixed into an upmixed audio signal describing a plurality of upmixed audio channels, wherein the upmixing parameters are applied to upmix the downmix audio signal using the decorrelated signal in order to achieve a first upmixed audio channel signal and a second upmixed audio channel signal, wherein a time-variant phase shift is applied to the downmix audio signal to achieve at least two versions of the downmix audio signal comprising a time-variant phase shift with respect to each other; and wherein the at least two versions of the downmix audio signal are combined with the decorrelated signal to achieve at least two upmixed audio channel signals such that the decorrelated signal remains unaffected by the time-variant phase shift when the computer program runs on a computer.

15. A non-transitory computer readable medium comprising a computer program for performing a method for achieving a set of upmix parameters for upmixing a downmix audio signal into an upmixed audio signal describing a plurality of upmixed audio signals, the method comprising:

achieving real-valued upmix parameters describing a desired intensity of contributions of the downmix signal and of the decorrelated signal to the upmixed audio channel signals in dependence on one or more spatial cues representing the intensity of the contribution;

achieving phase-shift-angle values describing a desired phase shift between downmix audio signal components in different upmixed audio channel signals in dependence on one or more spatial cues representing an inter-channel phase difference; and rotating real-valued upmix parameters intended to be applied to the downmix audio signal in dependence on the phase-shift-angle values, while leaving real-valued upmix parameters intended to be applied to the decorrelated signal unaffected by the phase-shift-angle values, to achieve completed upmix parameters of the set of upmix parameters, when the computer program runs on a computer.

16. A method for upmixing a downmix audio signal into an upmixed audio signal describing one or more upmixed audio channels, the method comprising:

applying upmixing parameters to upmix the downmix audio signal in order to achieve the upmixed audio signal;

wherein applying upmixing parameters comprises applying a phase shift to the downmix audio signal to achieve a phase-shifted version of the downmix audio signal while leaving a decorrelated signal unmodified by the phase shift; and wherein applying the upmixing parameters comprises combining the phase-shifted version of the downmix audio signal with the decorrelated signal to achieve the upmixed audio signal;

multiplying an input vector representing one or more samples of the downmix audio signal and one or more samples of the decorrelated signal with a matrix comprising matrix entries representing the upmix parameters to achieve, as a result, an output vector representing one or more samples of a first upmixed audio channel signal and one or more samples of a second upmixed audio channel, and achieving the matrix entries on the basis of spatial cues associated with the downmix audio signal, and applying a time-variant phase rotation only to matrix entries to be applied to one or more samples of the downmix signal, while leaving a phase of matrix entries to be applied to the one or more samples of the decorrelated signal unaffected by the time-variant phase rotation.

17. A non-transitory computer readable medium comprising a computer program for performing a method for upmixing a downmix audio signal into an upmixed audio signal describing one or more upmixed audio channels, the method comprising:

applying upmixing parameters to upmix the downmix audio signal in order to achieve the upmixed audio signal;

wherein applying upmixing parameters comprises applying a phase shift to the downmix audio signal to achieve a phase-shifted version of the downmix audio signal while leaving a decorrelated signal unmodified by the phase shift; and wherein applying the upmixing parameters comprises combining the phase-shifted version of the downmix audio signal with the decorrelated signal to achieve the upmixed audio signal, multiplying an input vector representing one or more samples of the downmix audio signal and one or more samples of the decorrelated signal with a matrix comprising matrix entries representing the upmix parameters to achieve, as a result, an output vector representing one or more samples of a first upmixed audio channel signal and one or more samples of a second upmixed audio channel, and achieving the matrix entries on the basis of spatial cues associated with the downmix audio signal, and applying a time-variant phase rotation only to matrix entries to be applied to one or more samples of the downmix signal, while leaving a phase of matrix entries to be applied to the one or more samples of the decorrelated signal unaffected by the time-variant phase rotation when the computer program runs on a computer.

* * * * *